US006014772A

United States Patent [19]

Connelly

[11] Patent Number: 6,014,772

[45] Date of Patent: Jan. 18, 2000

[54] MULTI-PURPOSE CONVERTIBLE GARMENT WITH ADJUSTABLE SIDE VENTS

[76] Inventor: Martin P. Connelly, 20722 Highway 2 West, East Glacier, Mont. 59434

[21] Appl. No.: 08/921,869

[22] Filed: Aug. 25, 1997

[51] Int. Cl.[7] ..... A41B 1/00

[52] U.S. Cl. ..... 2/69; 2/102

[58] Field of Search ..... 2/69, 69.5, 88, 2/102, 115, 108, 85, 93, 94, 95, 82, 84, 114, 106

[56] References Cited

U.S. PATENT DOCUMENTS

| | | | |
|---|---|---|---|
| D. 296,605 | 7/1988 | Asher | 2/69 X |
| D. 360,517 | 7/1995 | Reisenstein . | |
| 1,432,249 | 10/1922 | Hoyme | 2/69 |
| 1,489,046 | 4/1924 | Thompson | 2/114 |
| 1,927,179 | 9/1933 | Levinsohn . | |
| 2,130,771 | 9/1938 | Mann | 2/69 |
| 2,144,875 | 1/1939 | Forrest . | |
| 2,293,444 | 8/1942 | Muccillo . | |
| 3,013,274 | 12/1961 | Dike . | |
| 3,079,611 | 3/1963 | Boryszewski | 2/69 |
| 3,116,491 | 1/1964 | Previdi et al. | 2/106 |
| 3,276,036 | 10/1966 | Cater | 2/114 |
| 3,381,306 | 5/1968 | Innes | 2/69 |
| 3,638,241 | 2/1972 | Holmes . | |
| 4,062,064 | 12/1977 | Vosatka . | |
| 4,180,867 | 1/1980 | Ridgeway, Jr. | 2/88 X |
| 4,554,682 | 11/1985 | Hillquist . | |
| 4,656,670 | 4/1987 | Schluter | 2/69 X |
| 4,833,732 | 5/1989 | Harmsen . | |

*Primary Examiner*—Gloria M. Hale
*Attorney, Agent, or Firm*—Emrich & Dithmar

[57] ABSTRACT

A single piece garment is convertible between a vest or sleeveless sweater, and a poncho, or cape, and may also be used as a blanket or sleeping pad. The garment includes a neck opening with attached zipper and right and left pockets each with a zipper closure. The garment further includes right and left side zippers extending downward from respective right and left arm openings to the bottom edge of the garment. The side zippers allow the garment to be worn as a vest with the zippers fully closed or as a poncho with the zippers fully open. Intermediate closure positions of the zippers between the full opened and full closed positions allow venting of the garment to the extent desired by the wearer. Clasps below the wearer's armpits provide a tight fit about the wearer's upper arms when worn as a vest and permit the zippers to be fully open for maximum side venting while providing secure attachment of the garment to the wearer's upper torso. A flap attached to an inner portion of the garment adjacent the neck opening is adapted for positioning over the neck opening to provide a continuous, flat configuration of the garment for use as a blanket or sleeping pad.

8 Claims, 2 Drawing Sheets

MULTI-PURPOSE CONVERTIBLE GARMENT WITH ADJUSTABLE SIDE VENTS

FIELD OF THE INVENTION

This invention relates generally to garments and is particularly directed to a garment convertible between a vest or sleeveless sweater and a poncho or cape, which includes side vents continuously adjustable between full closed and full opened positions.

BACKGROUND OF THE INVENTION

The increasingly popularity of outdoor activities such as hiking, bike riding, rock climbing, skiing (Nordic and Alpine), etc., have increased the demand for outdoor garments capable of accommodating changing weather and temperature conditions as well as a wide range of physical activity. Garments for use in such activities should keep the wearer relatively dry and warm in inclement conditions, while being "breathable" and providing access to ambient air as the outside temperature increases for increased wearer comfort. Such garments should also provide the wearer with complete freedom of movement of arms, legs and torso and should be simple in design and configuration and preferably unitary, or made from a single piece of material, in construction. Finally, the garment when removed by the wearer should be capable of performing other functions typically encountered in outdoor activities.

The present invention offers the aforementioned advantages in a single piece garment convertible between a vest or sleeveless sweater and a poncho or cape, which may also be used as a blanket or sleeping pad when removed by the wearer.

OBJECTS AND SUMMARY OF THE INVENTION

Accordingly, it is an object of the present invention to provide a multi-purpose, single piece garment which may also be used as a blanket or sleeping pad.

It is another object of the present invention to provide a garment particularly adapted for outdoor use having side vents continuously adjustable between full opened and full closed positions for wearer comfort.

Yet another object of the present invention is to provide a flexibly configured garment convertible between a vest or sleeveless sweater and a poncho or cape.

This invention contemplates a garment comprising: a single piece of fabric adapted for folding over the shoulders of a wearer of the garment so as to form front and back portions respectively disposed over the front and back of the wearer's torso; a neck opening for receiving the head and neck of the wearer; right and left continuously adjustable closures, each having respective upper and lower ends, for connecting adjacent front and back portions of the garment, wherein the closures are adapted for assuming open and closed positions and a continuous range of positions intermediate therebetween; and right and left arm openings, wherein the right and left arm openings are disposed at respective upper ends of the right and left closures for permitting the garment to be worn as a vest when the closures are closed and for permitting the garment to be worn as a poncho when the closures are open, and wherein intermediate positions of the right and left closures provide side venting for the garment when worn as a vest.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
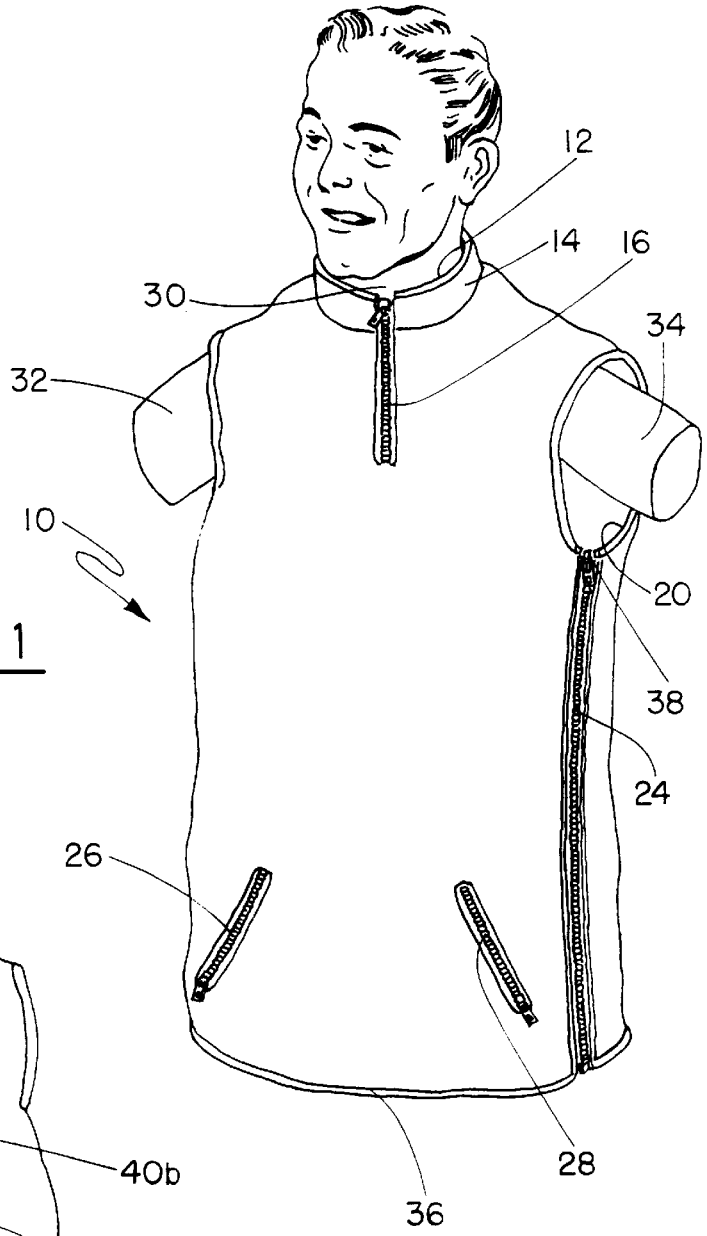
FIG. 1 is a perspective view of a garment with side zippers shown as worn by a person in accordance with the principles of the present invention.
Figure 2:
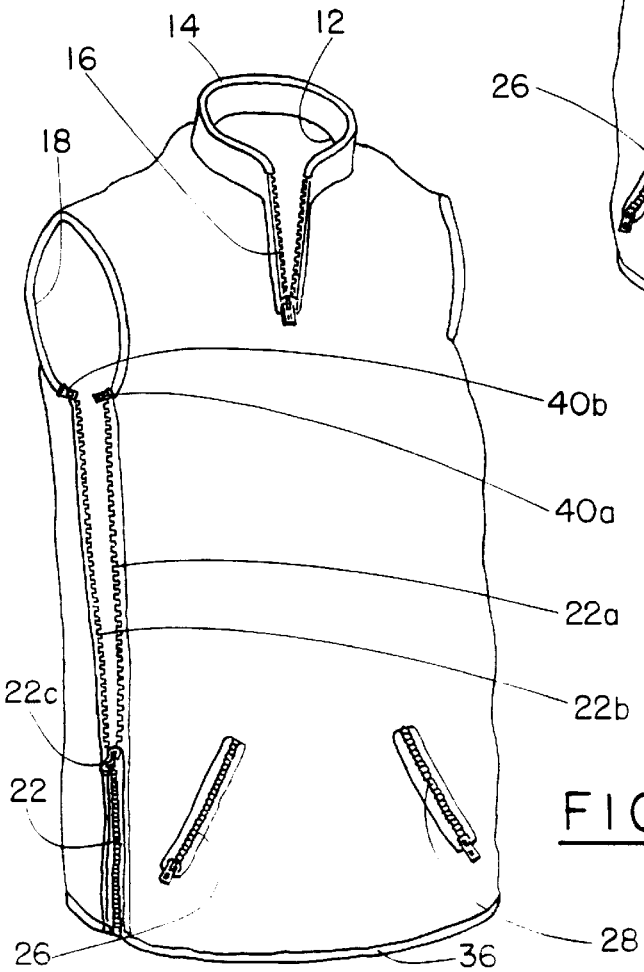
FIG. 2 is a perspective view of the inventive garment with side zippers showing one of the side zippers partially open.
Figure 3:
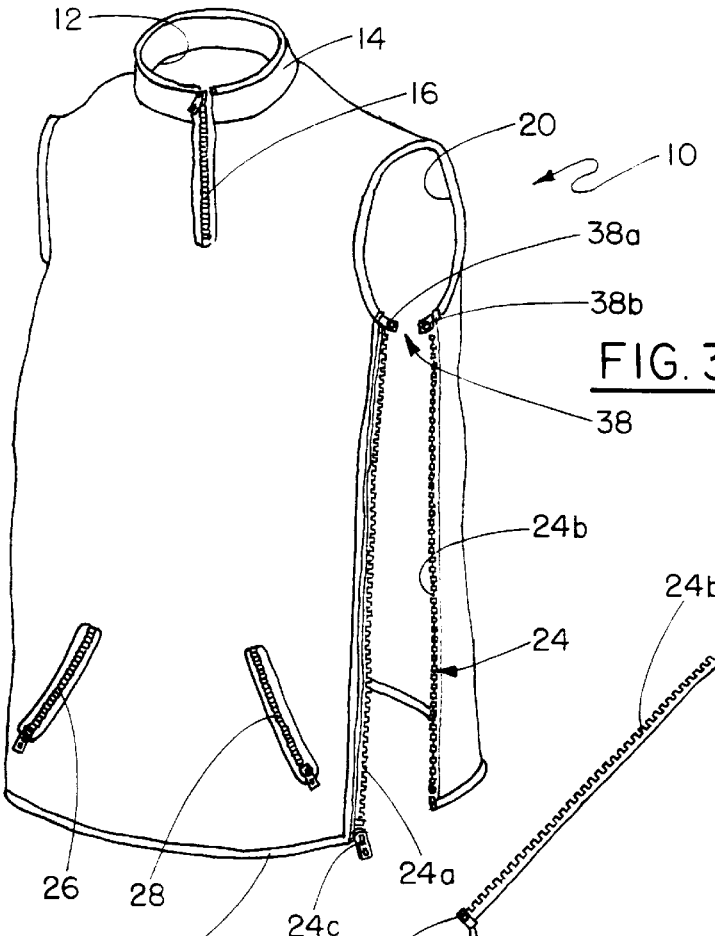
FIG. 3 is a perspective view of the inventive garment with side zippers showing one of the side zippers fully open.

Referring to FIG. 1, there is shown a perspective view of a garment 10 with side zippers in accordance with the present invention. Perspective views of the inventive garment 10 are also shown in FIGS. 2 and 3, respectively illustrating a side zipper partially open and fully open.

Figure 4:
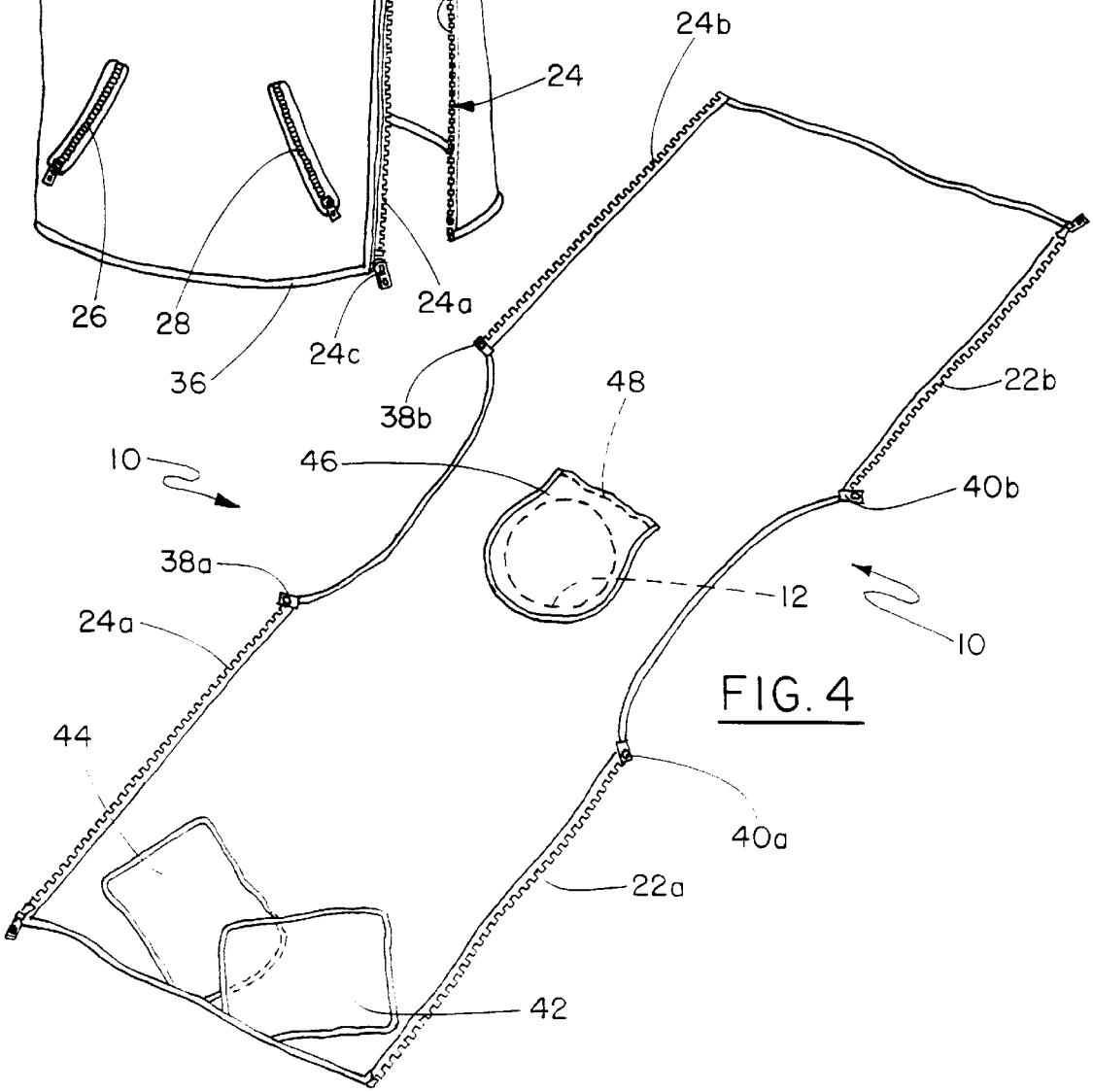
FIG. 4 shows the inventive garment with side zippers with the side zippers open and the garment configured for use as a blanket or sleeping pad.

The inventive garment 10 consists of a single piece of fabric and is adapted for positioning over a wearer's shoulders as shown in FIG. 1 so as to form forward and rear portions respectively disposed over the front and rear of the wearer's torso. Garment 10 includes a collar 14 in an upper portion thereof disposed about a neck opening 12. The neck 30 of a wearer extends through the neck opening 12, with the collar 14 positioned about the wearer's neck 30 in a close fitting manner with a front zipper 16 closed as shown in FIG. 1. Garment 10 further includes right and left side zippers 22 and 24. The terms "right" and "left" are used herein from the perspective of a wearer of garment 10. Each of the side zippers 22,24 is conventional in design and operation and includes, as shown for the case of the right side zipper 22 in FIG. 2, first and second zipper sections 22*a* and 22*b* as well as a sliding tab 22*c*. The right and left side zippers 22,24 connect adjacent edges of the front and rear portions of the garment 10 when worn as a vest or sleeveless sweater. Other conventional coupling arrangements are available for connecting the garment's front and rear portions, with zippers preferred. Garment 10 further includes right and left arm openings 18 and 20 for receiving the right and left arms 32 and 34, respectively, of a wearer. Disposed at a lower portion of each of the right and left arm openings is a clasp as shown for the case of clasp 38 disposed beneath the left arm opening 20 in FIG. 1. Each clasp is preferably of the snap-acting type and includes first and second snap connectors 40*a* and 40*b* as shown for the right clasp in FIG. 2. Other conventional garment clasps could be used equally as well with the inventive garment 10. FIG. 3 shows the left side zipper 24 in the full open position and including first and second zipper sections 24*a* and 24*b* as well as a sliding tab 24*c*. Also shown in FIG. 3 is the left clasp 38 in the open configuration and including first and second snap-connecting members 38*a* and 38*b*. A lower hem 36 is disposed on the bottom edge of the garment 10. Disposed on a forward, lower portion of garment 10 are right and left pocket zippers 26 and 28. Disposed within the garment 10 immediately adjacent to the right and left pocket zippers 26,28 are right and left pockets 42 and 44, respectively, which are shown in FIG. 4 illustrating the garment 10 laying flat with the right and left side zippers completely detached, or open. Attached to an inner portion of the garment 10 by conventional means such as by stitching 48 (shown in dotted line form) and disposed adjacent the neck opening 12 is a flap 46 shown in FIG. 4. Flap 46 covers the neck opening 12 when the garment 10 is laid flat for use either as a blanket or sleeping pad. With flap 46 disposed over the neck opening 12, garment 10 assumes a continuous, flexible body cover or support for use as a blanket or sleeping pad.

In the configuration shown in FIG. 1, garment 10 is worn as a vest or sleeveless sweater. In the configuration shown in FIG. 3 with the right and left side zippers fully open, garment 10 assumes the form of a poncho or cape worn over the wearer's shoulders and loosely disposed about the wearer's torso. This latter configuration provides maximum venting for the wearer allowing the maximum extent of ambient air circulation about the wearer's torso. An intermediate configuration between those shown in FIGS. 1 and 3 is shown in FIG. 2, where the right side zipper 22 is shown in the partially open configuration. The left side zipper may also be partially open, although this is not shown in FIG. 2 for simplicity. If the side zippers 22,24 are partially open as shown in FIG. 2, limited venting is provided for the wearer. Virtually any degree of venting may be provided for wearer comfort between the full closed and full opened positions respectively shown in FIGS. 1 and 3.

Garment 10 is preferably comprised of polartec material. The right and left pockets 42,44 are preferably comprised of a supplex nylon. Edging is disposed about the right and left arm openings 18,20, which edging is preferably comprised of polyester rib knit with lycra. Lower hem 36 is also preferably comprised of polyester rib knit with lycra.

There has thus been shown a unitary, or single piece, garment convertible between a vest or sleeveless sweater and a poncho or cape, which may also be used as a blanket or sleeping pad. The garment consists of a single piece of fabric and is adapted for positioning over the shoulders of a wearer so as to form front and rear portions respectively disposed over the front and rear of the wearer's torso. The garment includes right and left side zippers extending from a respective arm opening to the bottom edge of the garment. With the side zippers fully engaged, or closed, the garment is disposed snugly about the wearer's torso in the form of a vest or sleeveless sweater. The right and left side zippers may be open as desired to provide virtually any level of venting for the wearer. With the zippers fully opened, the garment assumes the form of a poncho or cape loosely disposed about the wearer's torso. Snap-acting clasps each disposed at the upper end of a respective side zipper and adjacent a wearer's armpit provide a snug fit for the wearer when used as a vest, while providing secure engagement with the upper torso of the wearer when worn as a poncho, if desired. Front zippered pockets are provided as is a front zipper extending downwardly from the neck opening. With the side zippers fully open, the garment may be laid flat for use as a blanket or sleeping pad. A flap is attached to the inner side of the garment adjacent the neck opening to overlay the neck opening when the garment is employed in the flat configuration for providing a continuous sheet of material for warmth or insulation when used as a blanket or sleeping pad.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A garment comprising:

a single piece of fabric adapted for folding over the shoulders of a wearer of the garment so as to form front and back portions respectively disposed over the front and back of the wearer's torso;

first means in said single piece of fabric for defining a neck opening for receiving the head and neck of the wearer;

right and left continuously adjustable closure means, each having respective upper and lower ends, for connecting adjacent front and back portions of the garment, wherein said closure means are adapted for assuming open and closed positions and a continuous range of positions intermediate therebetween;

second and third means in said single piece of fabric for defining right and left arm openings, wherein said right and left arm openings are disposed at respective upper ends of said right and left closure means for permitting the garment to be worn as a vest when said closure means are closed and for permitting the garment to be worn as a poncho when said closure means are open, and wherein intermediate positions of said right and left closure means provide side venting for the garment when worn as a vest; and right and left clasps respectively disposed between an upper end of said right closure means and said right arm opening and between an upper end of said left closure means and said left arm opening to provide a snug fit of the garment about the shoulders of the wearer when worn as a vest or as a poncho.

2. The garment of claim 1 wherein said right and left adjustable closure means comprise right and left zippers.

3. The garment of claim 1 wherein said right and left clasps each comprise a respective snap-acting connector.

4. The garment of claim 1 further comprising a front zipper disposed in said front portion of the garment and extending downward from said neck opening.

5. The garment of claim 4 further comprising right and left pockets disposed in said front portion of the garment.

6. The garment of claim 5 further comprising right and left front zippers respectively disposed over said right and left pockets.

7. The garment of claim 1 further comprising a flap attached to said single piece of fabric adjacent said neck opening therein for covering said neck opening when said right and left closure means are opened and said single piece of fabric is laid flat for use as a blanket or sleeping bag.

8. The garment of claim 7 further comprising stitching for attaching said flap to said single piece of fabric.

* * * * *